United States Patent [19]

Mohn et al.

[11] 4,369,089

[45] Jan. 18, 1983

[54] APPARATUS FOR CHANGING THE LABEL MAGAZINE BOXES OF LABELLING MACHINES

[75] Inventors: Hans-Werner Mohn, Kaarst; Rudolf Zodrow, Düsseldorf, both of Fed. Rep. of Germany

[73] Assignee: Jagenberg-Werke AG, Düsseldorf, Fed. Rep. of Germany

[21] Appl. No.: 257,090

[22] Filed: Apr. 24, 1981

[30] Foreign Application Priority Data

Apr. 30, 1980 [DE] Fed. Rep. of Germany ..... 3016599

[51] Int. Cl.[3] ..... B65C 9/02; B65C 9/10

[52] U.S. Cl. ..... 156/568; 156/571; 156/573; 156/DIG. 25; 156/DIG. 29; 221/105; 271/9; 271/33; 271/158

[58] Field of Search ..... 156/565, 567, 568, 570, 156/571, 573, DIG. 29, DIG. 25; 271/3.1, 9, 33, 157, 158, 159; 221/104, 105, 106

[56] References Cited

U.S. PATENT DOCUMENTS 3,698,601 10/1972 Sierk et al. ..... 221/105

3,929,326 12/1975 Seragnoli ..... 271/9

*Primary Examiner*—Michael G. Wityshyn

*Attorney, Agent, or Firm*—Sprung, Horn, Kramer & Woods

[57] ABSTRACT

In a labelling machine including label pickup means, for delivering to the machine articles to be labelled and for removing from the machine labelled articles, at least two boxes for labels disposed alongside one another, one of said boxes being in active position, means permitting retracting and advancing in label stacking direction of that label box which is in active position, and guide means for the boxes to permit them to move transversely to the direction in which labels are stacked in the boxes so as to take said one box out of active position and to put another box in active position, the improvement wherein said guide means comprises a common support for said boxes, and means mounting said support for rotation about an axis so that said support can be rotated to place any of said boxes or none of said boxes into active labelling position. The support preferably comprises a circular disk rotatable about its center, the label boxes being arranged radially thereon.

3 Claims, 4 Drawing Figures

APPARATUS FOR CHANGING THE LABEL MAGAZINE BOXES OF LABELLING MACHINES

BACKGROUND OF THE INVENTION

The invention relates to an apparatus for the practice of the method of changing the label magazine boxes of labeling machines wherein the label box just emptied is moved away from the pickup point and a full label box is moved toward it during the interval of time in which successive pickup means reach the pickup point, in accordance with U.S. patent application Ser. No. 227,551, filed Jan. 22, 1981, now pending.

In modern labeling machines, the labels to be affixed to containers, and in particular to bottles, are individually and successively picked up by gluing segments and then transferred to a gripper cylinder which in turn transfers the label that has been coated with glue while on the gluing segment to the container to be labeled.

Since in high-speed labeling machines the label box is emptied in about five minutes, there is the problem of refilling the magazine box with labels. The label magazine boxes can be refilled by hand only with difficulty since usually a number of magazine boxes are disposed one on top of the other at the pickup point. The lowermost box contains the belly label, and the one above it the breast label; and above that two further boxes may be disposed, one for the neck label and one for the foil to be wrapped around the top of the bottle. This is why the boxes are accessible practically only from the rear for the purpose of refilling.

There have been many proposals for automating the refilling of label boxes. For example, German patent application DOS No. 21 16 912 describes a refilling apparatus of this type in which the labels are pushed by means of a plunger from supply boxes disposed on a turntable into the label box which is in the pickup position. Since the labels must be pushed up in the label box continuously, even during the refilling operation, at the rate at which they are picked up, the transfer of the stack of labels pushed by the plunger into the label box to that conveying means is rather complicated and still requires semimanual operation.

Pickup of the labels poses still another problem that is a factor in the refilling of the label boxes. To avoid malfunctioning of the labeling machine, the label box located in the pickup position is always retracted from the pickup means when there is no container at the labeling point. This retracting of the label box is triggered by sensors located at the conveying path of the containers to be labeled. To permit this retracting of the label box, sufficient space must be provided, and the mass to be moved in retracting the label box must not be excessive. This is not necessarily the case with prior-art refilling apparatuses of the type disclosed in said German patent application DOS No. 21 16 912. Besides, there the retracting movement of the label box would conflict with the advancing movement in refilling the label box, that is to say, the label box could not be retracted during refilling, or then only with great difficulty.

Thus there is a need for an apparatus for changing the label magazine boxes of labeling machines which provides assurance that there will always be labels in the label box at the pickup point, that the label box can readily be moved into a position in which the pickup means are unable to pick up labels from it and there is nothing to interfere with that movement, and that manual handling is required only at considerable intervals of time so that one operator is able to attend several labeling machines.

In said earlier U.S. patent application Ser. No. 227,551, an apparatus was proposed for the practice of the method initially referred to wherein an empty label box can be replaced with a full one during the interval of time in which successive pickup means reach the pickup point. Said apparatus is characterized by at least two label boxes which are disposed side by side and which are adapted to be displaced as a unit in a direction transverse to the label stack direction on a guide track formed by rails, rods, tables, chains or belts, the particular box which is in the pickup position being adapted to be retracted and advanced in the label stack direction.

SUMMARY OF THE INVENTION

The present invention relates to an alternative to the apparatus proposed in said earlier U.S. patent application which serves the same purpose, namely, to permit a quick label-magazine change.

The apparatus in accordance with the invention is distinguished by the characteristics set forth in the claims.

BRIEF DESCRIPTION OF THE DRAWINGS

The apparatus in accordance with the invention will now be described in greater detail with reference to the embodiments illustrated in the accompanying drawings, wherein:

FIG. 3 shows it in a third position, while

DETAILED DESCRIPTION OF THE INVENTION

Figure 1:
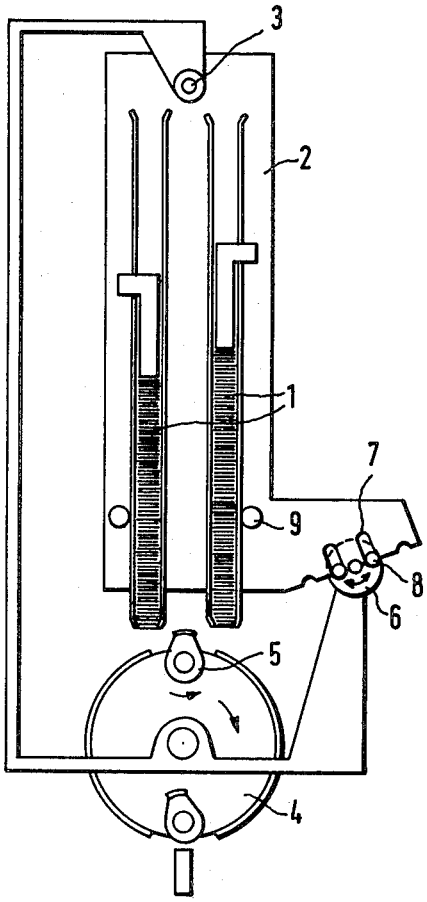
FIG. 1 shows an embodiment of the apparatus of the invention in one position.
Figure 3:
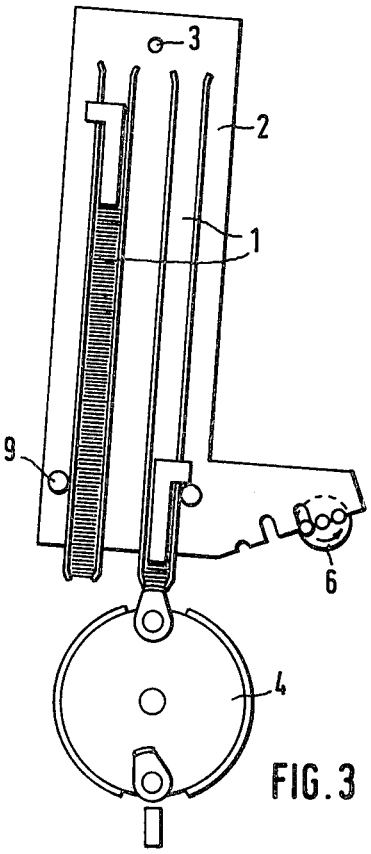

In the embodiment of the apparatus in accordance with the invention shown in FIGS. 1 and 3, two magazine boxes 1 are combined into one structural unit on a plate 2, a frame, or a similar supporting structure. The plate 2 is mounted to pivot on a stud 3. Said stud may be disposed horizontally, with the magazine boxes 1 extending vertically along the supporting structure 2, which constitutes a very practical arrangement especially when narrow labels, tax strips or the like are to be picked up. Opposite the label magazine boxes 1, gluing segments 5 serving as pickup means are pivotably or rotatably mounted on a rotatable disk 4.

In FIG. 1, the supporting structure 2 with the label magazine boxes 1 is shown pivoted into a neutral position in which the pickup means 5 are unable to pick up labels from the magazine boxes 1. This is the position selected when a bottle is missing in the labeling machine. To this end, sensing means (not shown) are provided in the labeling machine which when a bottle is missing transmit a signal to a servomotor 6, which then rotates to pivot the supporting structure 2 into the neutral position shown in FIG. 1 by means of pins 8 dropping into slots 7 in said supporting structure.

Figure 2:
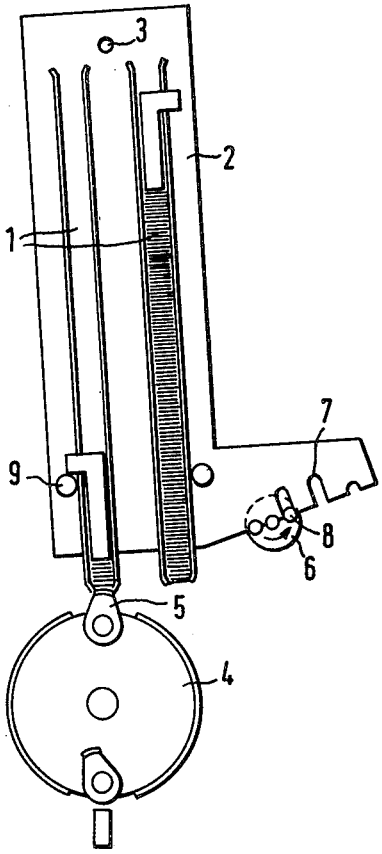
FIG. 2 shows it in another position.

FIG. 2 shows the apparatus in accordance with the invention in a position in which a sensor 9, which may be a proximity detector, for example, indicates that the left label magazine box 1 is substantially empty and transmits a signal to the servomotor 6, which is then energized to pivot the supporting structure 2, during the interval of time in which two successive pickup means 5 reach the pickup point, from the end position shown in FIG. 2 into the position shown in FIG. 3 so as to move the right label magazine box 1 (FIG. 2), meanwhile refilled, into the pickup position.

Illustrated in FIG. 3 is the situation in which the proximity detector 9 again energizes the servomotor 6 after the right label magazine box 1 has been emptied, in order to pivot the meanwhile refilled left label magazine box 1 into the pickup position, which is that shown in FIG. 2.

Figure 4:
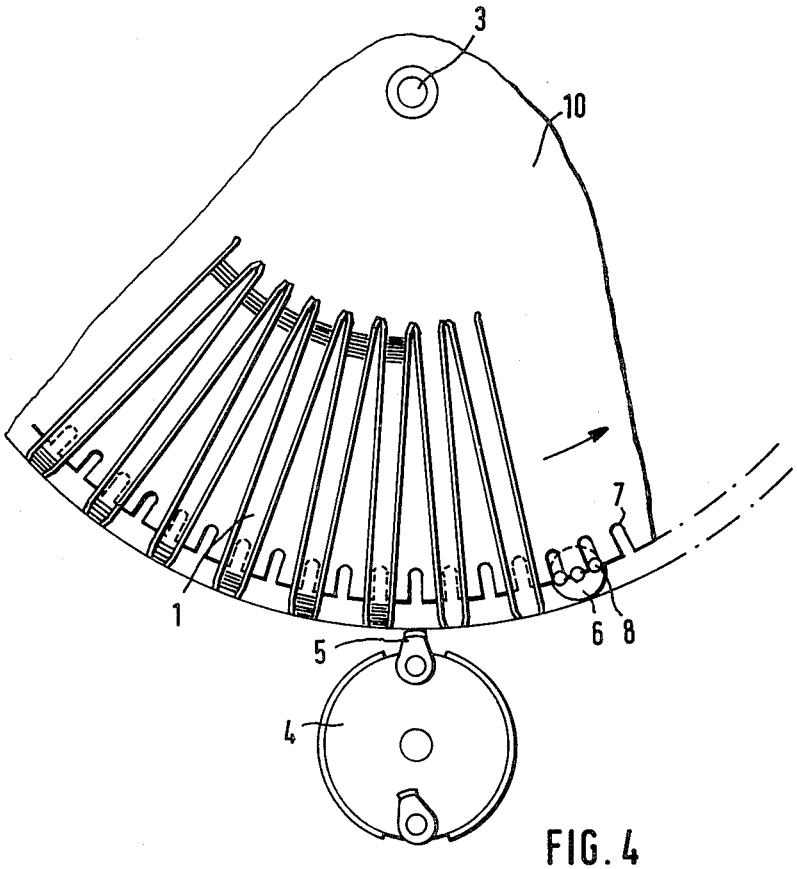
FIG. 4 is a fractional view of a further embodiment.

In the embodiment shown in FIG. 4, the supporting structure 10 has the form of a rotatable disk which is radially provided with label boxes 1 and is adapted to be rotated about the stud 3 by means of a servomotor 6 in the manner described in connection with the embodiment shown in FIG. 1. FIG. 4 illustrates the position of the supporting structure 10 in which no label box 1 is located at the pickup point. This is an intermediate position which is selected when because of a missing bottle in the conveying track of the label machine no label is to be picked up by the pickup means 5.

It will be appreciated that the instant specification and claims are set forth by way of illustration and not of limitation, and that various changes and modifications may be made without departing from the spirit and scope of the present invention.

What is claimed is:

1. In a labelling machine including label pickup means, means for delivering to the machine articles to be labelled and for removing from the machine labelled articles, at least two boxes for labels disposed alongside one another, one of said boxes being in active position, means permitting retracting and advancing in label stacking direction of that label box which is in active position, and guide means for the boxes to permit them to move transversely to the direction in which labels are stacked in the boxes so as to take said one box out of active position and to put another box in active position, the improvement wherein said guide means comprises a common support for said boxes, and means mounting said support for pivoting to and fro about an axis at a right angle to the longitudinal direction of said boxes so that said support can be pivoted to place any of said boxes or none of said boxes into active labelling position.

2. An apparatus according to claim 1, wherein the support comprises a circular disk rotatable about its center, the label boxes being arranged radially thereon.

3. An apparatus according to claim 1, wherein the means permitting retracting and advancing are operatively connected with the label pickup means so that retraction of one label box and advance of another are effected during the interval when successive pickup means reach the pickup point.

* * * * *